US005215367A

United States Patent [19]

Montuoro et al.

[11] Patent Number: 5,215,367

[45] Date of Patent: Jun. 1, 1993

[54] REFRIGERATOR DOOR HINGE

[75] Inventors: Louis D. Montuoro, Cedar Rapids; James M. Grace, Elberon; Matthew W. Allison, Cedar Rapids, all of Iowa

[73] Assignee: Amana Refrigeration, Inc., Amana, Iowa

[21] Appl. No.: 888,565

[22] Filed: May 22, 1992

[51] Int. Cl.[5] ..... A47B 97/00

[52] U.S. Cl. ..... 312/401; 312/351.13; 16/32; 248/188.4

[58] Field of Search ..... 312/401, 351.13, 405, 312/351.12, 351.1, 351.11; 49/396, 381, 382; 16/DIG. 43, 221, 32, 19, 387, 390, 392; 248/213.1, 188.4, 188.8

[56] References Cited

U.S. PATENT DOCUMENTS 2,803,510 8/1957 Carbary ..... 312/351.13
2,874,971 2/1959 Devery ..... 312/351.13
3,482,894 12/1969 Pryor ..... 312/351.13
4,151,681 5/1979 Roberts ..... 411/970 X
4,590,709 5/1986 Katsman ..... 49/396
5,046,790 9/1991 Onomoto et al. ..... 312/351.13

*Primary Examiner*—Rodney M. Lindsey
*Attorney, Agent, or Firm*—William R. Clark; Richard M. Sharkansky

[57] ABSTRACT

A refrigerator door hinge including a bracket connected to and extending forwardly from the face of the cabinet on the side to which the door opens. The bracket includes an upper horizontal plate supporting the door, and a lower horizontal plate with a threaded aperture which captures a threaded post of a foot. The bottom of the foot has a pad and during installation, the foot is rotated to lower the foot until the pad contacts the floor thereby providing adjustable height hinge support directly to the floor.

7 Claims, 1 Drawing Sheet

REFRIGERATOR DOOR HINGE

BACKGROUND OF THE INVENTION

The field of the invention generally relates to refrigerators, and more particularly relates to door mounting apparatus for refrigerators.

As is well known, refrigerator doors are typically mounted using hinges that include brackets that are connected to the face of the cabinet and extend forwardly from the side to which the door opens. These brackets normally have a horizontal plate with an aperture that captures a pin extending vertically from the door. It is desirable that the pivot point of the door be relatively far forward from the face of the cabinet to keep the door swing within the lateral profile of the cabinet. More specifically, it is desirable to be able to position a refrigerator flush against a room wall and open the door towards the wall. For this purpose, it is necessary that the edge of the door not rotate out beyond the side of the cabinet as the door opens.

A current trend is to make refrigerator doors larger to increase their capacity so that more food products such as beverages can be readily accessed therefrom. The combination of heavy doors with pivot points relatively far in front of the cabinet face has led to relatively large forces on the hinges and the hinge mounting surfaces. Further, with a large capacity door, there may be a tendency for a refrigerator to tip forward when a fully loaded door is opened. Also, refrigerators are typically supported on rollers, and the force exerted on a refrigerator when opening the door may cause the refrigerator to move or pull forward.

SUMMARY OF THE INVENTION

It is an object of the invention to provide an improved hinged assembly for a refrigerator.

It is a further object to provide a refrigerator hinge assembly that permits the door to be swung open within the lateral profile of the cabinet so that the refrigerator can be placed flush against a room wall. In particular, it is an object to position the pivot point of the door relatively far in front of the cabinet face.

It is also an object to provide a refrigerator hinge that can support a large capacity door storing many heavy objects.

It is further object to provide a refrigerator that is stable and resists tipping forward even though a fully loaded large capacity door is open.

It is also an object to provide a hinge assembly that reduces the force and stress exerted on the hinge and the hinge mounting surface of the cabinet face.

It is also an object to provide a refrigerator that does not move or rock forward when the door is opened.

These and other objects and advantages are provided by a refrigerator comprising a cabinet having a front face, rollers mounted to the underside of the cabinet for rolling the refrigerator on a floor, a hinge mounted to the front face of the cabinet and extending forwardly, the hinge having a foot of adjustable height for supporting the hinge directly from the floor, and a door supported from the hinge.

With such arrangement, cantilever support from the hinge mounting surface on the face of the cabinet is minimized, and the load of the door is substantially supported directly downwardly through the foot of adjustable height. In such manner, the relatively large capacity fully loaded doors can be used and the pivot points can be located relatively far forward without exerting undue stress on the hinge or its mounting surface. Further, the adjustable foot resists or reduces the tendency of the refrigerator to tip forward when the door is open. Also, the friction of the foot on the floor inhibits a refrigerator rolling forwardly when the door is being opened.

BRIEF DESCRIPTION OF THE DRAWINGS

The foregoing features of this invention, as well as the invention itself, may be more fully understood from the following detailed description of the drawings, in which.

DESCRIPTION OF THE PREFERRED EMBODIMENTS

Figure 2:
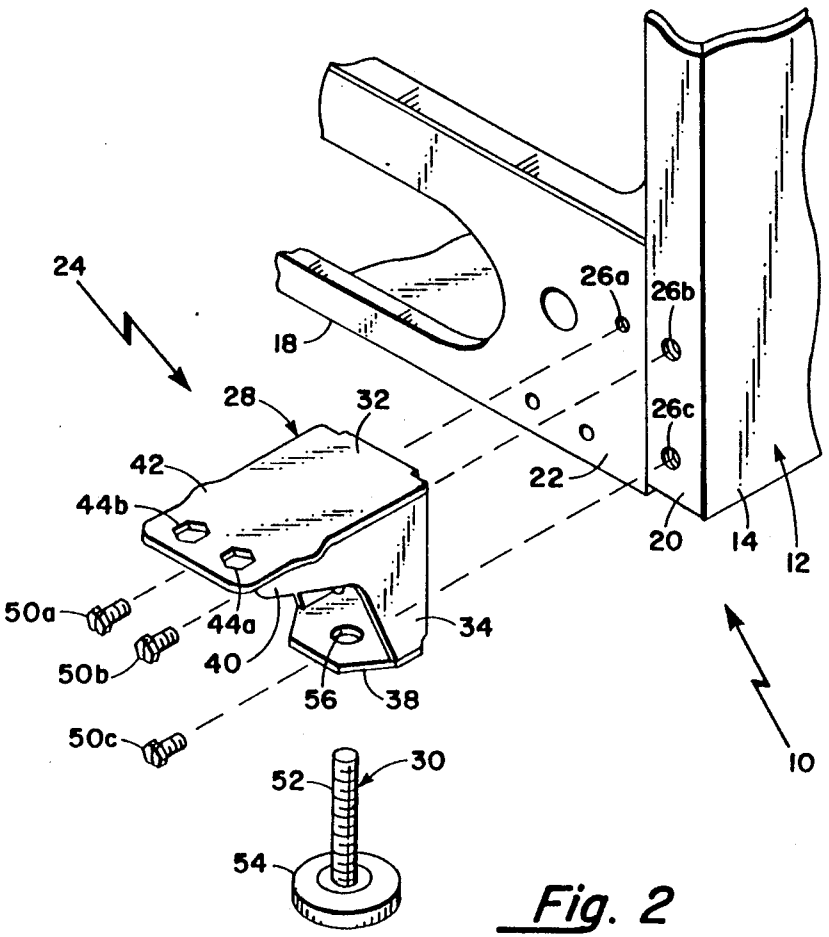
FIG. 2 is an exploded view showing the hinge assembly and a portion of the cabinet front face on which it mounts.
Figure 1:
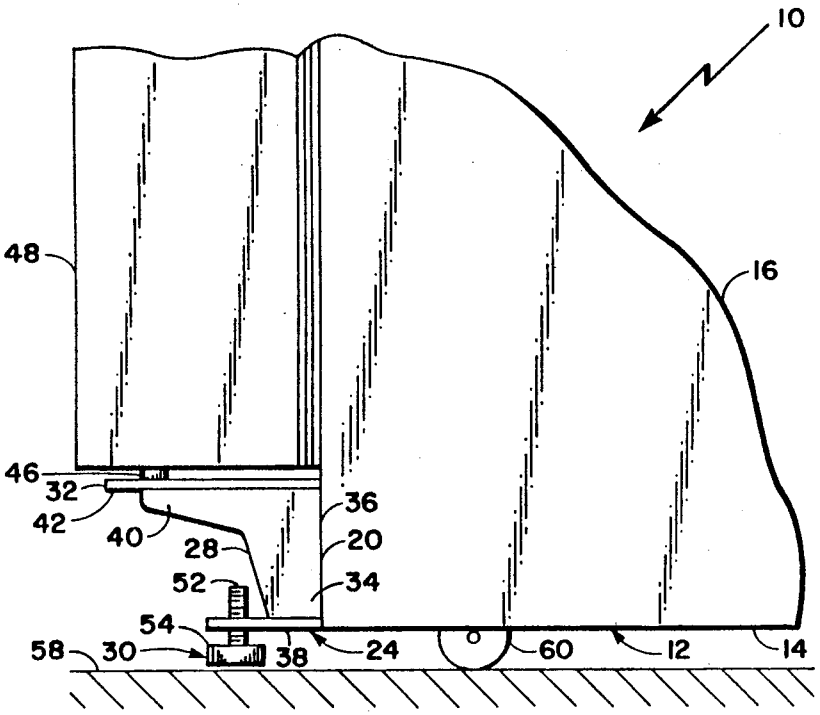
FIG. 1 is a side elevation view of a portion of a refrigerator showing the hinge assembly supporting the door.

Referring to FIGS. 1 and 2, refrigerator 10 includes a cabinet 12 of which one side wall 14 is here shown. In conventional manner, cabinet 12 may typically be fabricated by positioning an inner plastic liner (not shown) within an outer metal shell 16 or casing, and then injecting foam insulation (not shown) into the void therebetween. As shown in FIG. 2, a metal cross slat 18 is connected across the front of cabinet 12 at the bottom and along with a front edge 20 of cabinet side wall 14 forms a front face region 22 for mounting hinge assembly 24. Here, front face hinge mounting region 22 has mounting holes 26*a–c*.

Hinge assembly 24 includes bracket 28 or hinge and a foot 30 of adjustable height. Bracket 28 has a top plate 32, side plates 34, back plate 36, and bottom plate 38 all of which are formed as a unitary stamped part. As shown, side plates 34 have a forward projecting upper portion 40 that supports a front portion 42 of top plate 32 in which apertures 44*a* and 44*b* are disposed. One aperture 44*a* is used for capturing vertically oriented pin 46 of door 48 when the door 48 is hung to open from one side, here left, and the other aperture 44*b* is used for capturing pin 46 of door 48 when the door 48 is hung to open from the opposite side, here right.

In fabrication, mounting screws 50*a–c* are inserted through holes (not shown) in the back plate 36 of bracket 28 and into holes 26*a–c*. Bracket 28 is therefore mounted to front face region 22 of cabinet 12 in conventional manner.

In accordance with the invention, a foot 30 of adjustable height is connected to bottom plate 38. More specifically, foot 30 includes a threaded post 52 with a bottom pad 54 preferably of high friction, and the threaded post 52 is engaged in threaded opening 56 in bottom plate 38.

During installation of the refrigerator in a home, the refrigerator is rolled on the floor 58 to its desired location using a conventional set of permanently mounted rollers 60 on the bottom of cabinet 12. Then, foot 30 is rotated to adjust the height of pad 54. More specifically, threaded post 52 is rotated within threaded opening 56 to lower pad 54 until contact is made with floor 58.

In accordance with the invention, the weight of door 46 and its contents is largely supported directly by foot 30 thereby eliminating or at least substantially reducing the cantilever supporting force on front face region 22 where bracket 28 is mounted. With such arrangement, door 30 can be a large capacity door capable of storing many heavy food products such as milk cartoons without putting undue strain on bracket 28, mounting screws 50*a–c*, and front face region 22. Further, the pivot point of door 38 which is pin 46 can be positioned a relative large distance from front face region 22 because the moment arm is no longer of great importance because most of the weight is not supported therefrom in cantilever fashion. For example, pin 46 and opening 56 may be disposed approximately 3.5" from front face region 22. If the total weight were supported in cantilever fashion, the front face region 22 could bend or deform due to the heavy weight of door 48 and the relatively long moment arm. Also, the hanging orientation of the door 48 could change or the door could drop slightly altering its proper alignment with the access opening of refrigerator 10. Furthermore, refrigerator 10 is made more stable by foot 30, and because the weight of door 48 is supported farther to the front, refrigerator 10 is less likely to tip forwardly when door 38 is heavily loaded and open. Also, pad 54 is preferably made of a high friction material such as rubber thereby resisting refrigerator 10 from moving forward on rollers 60 when a force is exerted on door 48 to open it.

Having described preferred embodiments of the invention, it will now become apparent to one of skill in the art that other embodiments incorporating their concepts may be used. It is felt, therefore, that these embodiments should not be limited to disclosed embodiments, but rather should be limited only by the spirit and scope of the appended claims.

What is claimed is:

1. A refrigerator comprising:

a cabinet having a front face;

rollers mounted to the underside of said cabinet for moving said refrigerator on a floor;

a hinge mounted to said front face of said cabinet and extending forwardly therefrom, said hinge having a foot of adjustable height for supporting said hinge directly from said floor; and a door supported on said hinge.

2. The refrigerator, recited in claim 1, wherein said foot comprises a pad connected to a threaded post.

3. The refrigerator, recited in claim 2, wherein said hinge comprises a bottom plate, a top plate, and an interconnecting vertical member.

4. The refrigerator, recited in claim 3, wherein said bottom plate has a threaded aperture, and said threaded post of said foot is received in said aperture.

5. A refrigerator comprising:

a cabinet having a front face;

means comprising rollers mounted to the underside of said cabinet for enabling said refrigerator to be rolled along a floor;

a hinge mounted to said front face of said cabinet and extending forwardly therefrom;

a door rotatably supported on said hinge; and said hinge comprising means comprising a foot for supporting said hinge directly on said floor.

6. The refrigerator, recited in claim 5, wherein said supporting means comprises a foot of adjustable height.

7. The refrigerator, recited in claim 6, wherein said foot comprise a pad connected to a threaded post.

* * * * *